US006819296B2

(12) United States Patent
Scorer et al.

(10) Patent No.: US 6,819,296 B2
(45) Date of Patent: Nov. 16, 2004

(54) ANTENNAS

(75) Inventors: Michael Scorer, St. Albans (GB); Philip Charles Wilcockson, Hitchin (GB)

(73) Assignee: Smiths Group PLC, London (GB)

( * ) Notice: Subject to any disclaimer, the term of this patent is extended or adjusted under 35 U.S.C. 154(b) by 1 day.

(21) Appl. No.: 10/299,919

(22) Filed: Nov. 20, 2002

(65) Prior Publication Data

US 2003/0095074 A1 May 22, 2003

(30) Foreign Application Priority Data

Nov. 20, 2001 (GB) ..... 0127772

(51) Int. Cl.[7] ..... H01Q 13/10

(52) U.S. Cl. ..... 343/771; 343/700 MS; 343/785

(58) Field of Search ..... 343/700 MS, 746, 343/770, 771, 772, 785, 756

(56) References Cited

U.S. PATENT DOCUMENTS 4,488,157 A * 12/1984 Terakawa et al. ..... 343/771
4,618,865 A * 10/1986 Lamensdorf et al. ..... 343/776
4,755,821 A * 7/1988 Itoh et al. ..... 343/700 MS
4,829,312 A * 5/1989 Terakawa et al. ..... 343/756
4,841,308 A 6/1989 Terakawa et al. ..... 343/771

FOREIGN PATENT DOCUMENTS

| | | | |
|---|---|---|---|
| DE | 3418083 A1 | 11/1985 | ..... H01Q/13/28 |
| EP | 1035615 A1 | 9/2000 | ..... H01Q/3/26 |
| EP | 1130680 A2 | 9/2001 | ..... H01Q/13/28 |
| GB | 2157082 A | 10/1985 | ..... H01Q/13/20 |
| GB | 2158650 A | 11/1985 | ..... H01Q/19/15 |
| JP | 4286205 | 10/1992 | ..... H01Q/19/06 |
| WO | WO-95/29518 | 11/1995 | ..... H01Q/19/06 |

* cited by examiner

*Primary Examiner*—Hoang V. Nguyen
(74) *Attorney, Agent, or Firm*—Connolly Bove Lodge & Hutz LLP; Larry J. Hume

(57) ABSTRACT

A marine radar antenna has a single dielectric plate mounted in front of the waveguide polarization grid between two horn plates. A strip of dielectric material is secured to the upper and lower surfaces of the plate to form a forwardly and rearwardly facing step on each surface. The steps are located forwardly of the ends of the horn plates and are positioned to produce reflections substantially 180° out of phase with extraneous energy within the antenna. The dielectric plate is supported by a foamed plastics material within an outer radome.

17 Claims, 2 Drawing Sheets

ANTENNAS

BACKGROUND OF THE INVENTION

This invention relates to antennas.

The invention is more particularly concerned with radar antennas, such as for ships.

Conventional marine radar antennas are of bar shape and are mounted horizontally to rotate about a vertical axis. A slotted waveguide extends horizontally across the width of the antenna, the slots opening along a side of the waveguide into a horn. In order to achieve a beam with a relatively narrow width in elevation, the aperture of the horn in a vertical direction has to be relatively large. This results in an antenna having a relatively large size in the vertical direction. This is a disadvantage because it increases the wind resistance of the antenna so that it must be made relatively robust, have bearings of a heavy construction and be driven by a high power motor.

It has long been known that the dimensions of a radar antenna can be reduced by using a dielectric material. The dielectric has the effect of constraining the microwave energy as it emerges from the antenna and can enable the use of a lower profile antenna shape ("Gain enhancement of microwave antennas by dielectric-filled radomes", James et al, Proc. IEE, vol 122, no 12, December 1975, pp 1353–1358). WO95/29518 describes an antenna with several plates of dielectric material extending parallel to the direction of the main energy beam.

BRIEF SUMMARY OF THE INVENTION

It is an object of the present invention to provide an alternative antenna.

According to one aspect of the present invention there is provided an antenna including a waveguide extending along a first direction and arranged to propagate energy from a face of the guide in a second direction at right angles to the first direction, the antenna including a dielectric member of generally plate shape having an edge extending parallel to the face of the guide and having opposite surfaces facing in directions orthogonal to the first and second directions, and the dielectric member having at least one discontinuity on at least one of the surfaces arranged to scatter energy and enhance the properties of the energy radiated from the antenna.

The discontinuity preferably includes a step extending along the length of the dielectric member. The dielectric member may have two steps facing in opposite directions. The dielectric member may have a step on both surfaces and preferably has two steps facing in opposite directions on both surfaces. The or each discontinuity may be provided by a strip secured to each surface of the dielectric member to extend along its length. The antenna preferably has a single dielectric member, the thickness of the dielectric member being substantially less than the height of the antenna. The dielectric member is preferably of a foamed plastics material. The antenna preferably includes a polarisation grid located forwardly of the face of the waveguide, the antenna including two horn plates extending forwardly of the polarisation grid and a rear edge of the dielectric member being located between the horn plates. The or each discontinuity may be located forwardly of the horn plates. The location of the or each discontinuity is preferably selected to produce reflections that are substantially 180° out of phase with extraneous energy produced within the antenna. The location of the or each discontinuity is preferably selected to control sidelobes of a beam of the energy and to enhance peak gain. The dielectric member may be supported by an expanded foam material, which may be contained within an outer radome that extends rearwardly along the waveguide.

According to another aspect of the present invention there is provided a marine radar antenna including a waveguide extending along a first, horizontal direction for rotation about a vertical axis and arranged to propagate energy forwardly in a second, horizontal direction from a face of the guide at right angles to the first direction, the antenna including a dielectric member of generally plate shape having an edge extending parallel to the face of the guide and having opposite surfaces facing vertically up and down, and the dielectric member having at least one discontinuity on at least one of the surfaces arranged to scatter energy, to control sidelobes of a beam of the energy and to enhance peak gain.

A radar antenna for a ship, according to the present invention, will now be described, by way of example, with reference to the accompanying drawings.

DETAILED DESCRIPTION OF THE PREFERRED EMBODIMENT

Figure 1:
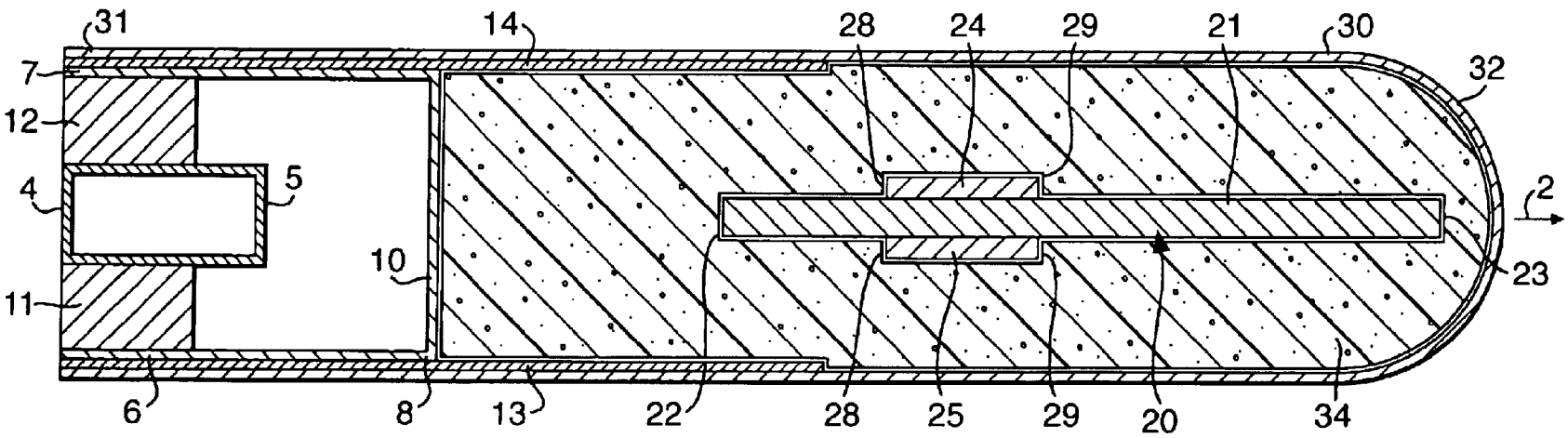
FIG. 1 is a sectional side elevation view of the antenna.
Figure 2:
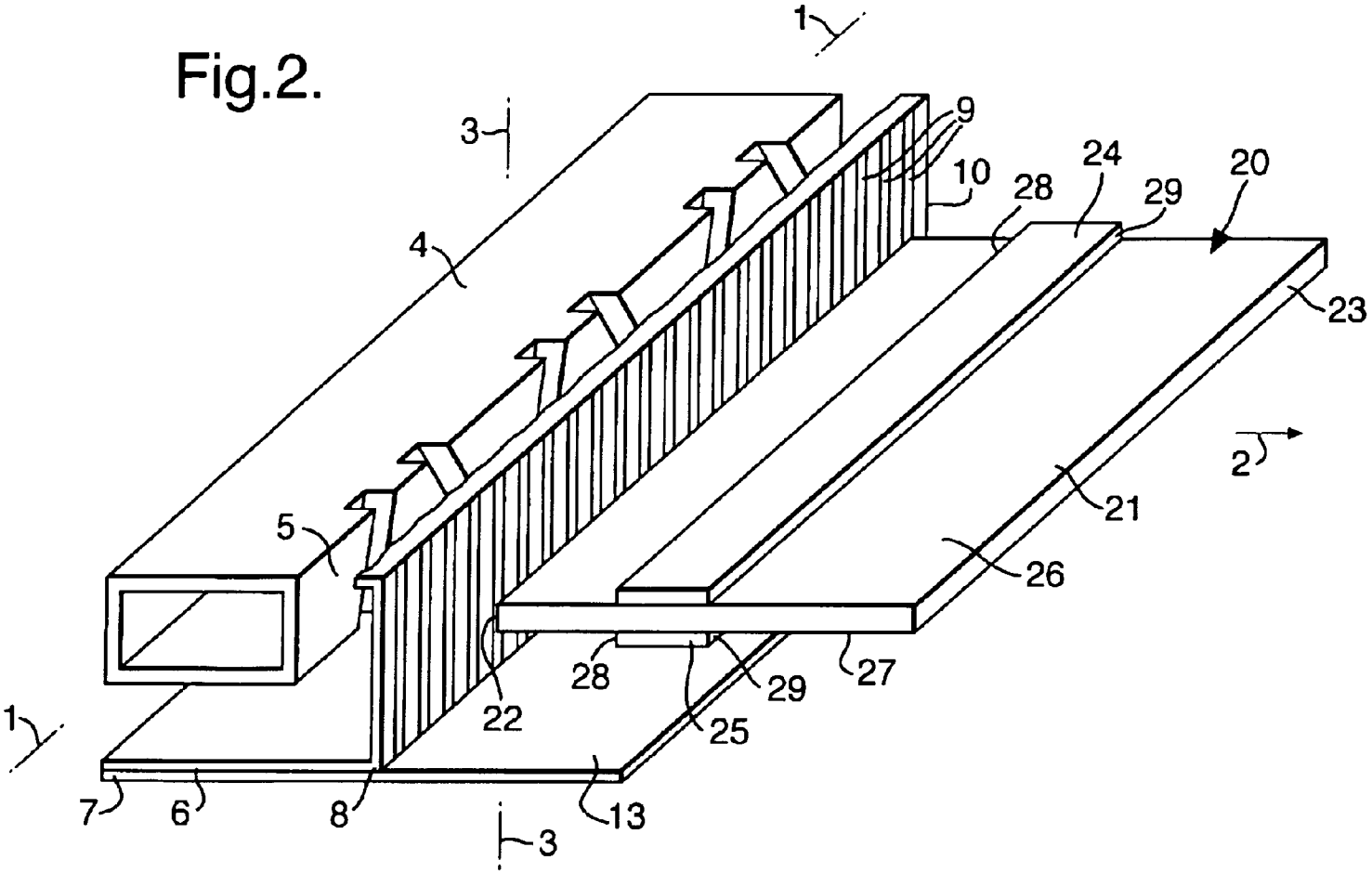
FIG. 2 is a perspective view of parts of the antenna.

The antenna extends in a horizontal direction 1 and directs a beam of radiation in a second horizontal direction 2 at right angles. The antenna is supported by a mount (not shown) for rotation about a vertical axis 3 so that the radiation beam is swept in azimuth.

A waveguide 4 extends across the width of the antenna at its rear side. The waveguide 4 is of hollow metal construction and rectangular section. The forward-facing vertical face 5 of the waveguide 4 is slotted in the usual way so that energy is propagated from this face. Energy is supplied to one end of the waveguide 4 from a conventional source (not shown). The waveguide 4 is supported within an intermediate housing 6 of sheet metal and rectangular section having an open rear end 7 and a forward end 8 that is closed by a wall cut with parallel vertical slots 9 to form a polarisation grid 10. The polarisation grid 10 is 94.1 mm high, is 1 mm thick and it is spaced from the slotted face 5 of the waveguide 4 by 57.4 mm. Two choke bars 11 and 12 extend along the waveguide 4 within the intermediate housing 6. Two metal horn plates 13 and 14 attached to the upper and lower surfaces of the intermediate housing 6 project forward of the polarisation grid 10 by a distance of 77 mm.

The antenna also includes a single dielectric member 20 having a plate 21, which is 13 mm thick, that is, substantially less than the height of the polarisation grid 10 and of the antenna itself. The plate 21 is of a foamed plastics, such as PVC, sold under the name Forex, and is rectangular in section, being 339 mm long, that is, in the direction 2 of beam propagation. The rear edge 22 of the plate 21 extends parallel to the waveguide 4 and the polarisation grid 10 and is spaced from the grid by 55.5 mm so that it is located between the horn plates 13 and 14. The forward edge 23 of the plate 21 extends parallel to the rear edge 22. Two strips 24 and 25 of the same material are bonded to the upper surface 26 and lower surface 27 respectively of the plate 21. The strips 24 and 25 are each 6 mm thick and 71 mm wide extending across the width of the plate 21. The strips 24 and 25 are spaced from the rear edge 22 of the plate 21 by 49.4 mm. The strips 24 and 25 each have a rear-facing vertical edge 28 and a forward-facing vertical edge 29 forming discontinuities in the surface of the dielectric member 20. Instead of using separate strips bonded to the plate, the plate could be formed integrally with the side strips, such as by moulding or by machining.

The dielectric member 20 is enclosed within a radome 30, which has an open rear end 31 sealed to the outside of the horn plates 13 and 14, and a domed, closed forward end 32. The radome 30 is 1 mm thick and is made of foamed PVC, such as Forex. Internally, the radome 30 has a height of 98.1 mm and is spaced from the forward edge 23 of the dielectric member 20 by 6 mm. The radome 30 provides environmental protection for the antenna on its forward-facing side; there is also some form of protective cover (not shown) along its rear-facing side. The dielectric member 20 is supported within the radome 30 by an expanded polystyrene foam material 34 filling the forward end of the radome and the space within the horn plates 13 and 14 forwardly of the polarisation grid 10.

In operation, a major part of the energy propagated from the waveguide 4 is loosely confined along the dielectric member 20 in the direction of the axis 2. Energy is also scattered from discontinuities within the antenna, such as the forward end of the horn plates 13 and 14. This other, extraneous, energy adversely affects the transmitted beam. The positioning of the discontinuities introduced by the steps 28 and 29 is selected to enhance the properties of the transmitted beam by producing reflections that are approximately 180° out of phase with this extraneous energy. It has been found that these discontinuities 28 and 29 can be used to control the sidelobes of the beam and to enhance the peak gain. The material 34 filling the radome 30 and the material of the radome itself do not have any appreciable effect on the transmitted beam.

The antenna of the present invention has a relatively small profile with a height of just over 100 mm but can produce a beam with characteristics similar to that of a conventional antenna having a height of around 300 mm. The reduced height reduces wind resistance of the antenna and reduces loading on the antenna bearings and the motor drive.

The strips 24 and 25 introduce two discontinuities on each side of the plate 21 but in other arrangements it may only be necessary to have one discontinuity and this may be provided on one side only. A single discontinuity could be provided by a strip that tapers across its width so that it produces a step along one edge and merges smoothly with the surface of the plate on the other edge. Discontinuities could be produced in other ways such as by narrow ribs or by slots or other indentations in the plate. The plate need not have a constant thickness along its length but could, for example, taper to a reduced thickness away from the waveguide. It will be appreciated that the dimensions given above are for a particular construction and are for an antenna operating in the S-Band at 3.05 GHz. The dimensions for different constructions and different frequency antenna can readily be determined by scaling the dimensions in proportion to the frequency and by further experimentation.

What I claim is:

1. An antenna comprising:

a waveguide extending along a first direction and arranged to propagate energy forwardly from a face of said waveguide in a second direction at right angles to the first direction; and a dielectric member of generally plate shape having an edge extending parallel to said face of said waveguide such that energy propagated from said waveguide enters said dielectric member at said edge, wherein said dielectric member has opposite surfaces facing in directions orthogonal to said first and second directions, and wherein said dielectric member has at least one discontinuity on at least one of said surfaces arranged to scatter energy and enhance the properties of the energy radiated from the antenna.

2. An antenna according to claim 1, wherein said dielectric member is a single dielectric member and the thickness of said dielectric member is substantially less than the height of the antenna.

3. An antenna according to claim 1, wherein said dielectric member is of a foamed plastics material.

4. An antenna according to claim 1, wherein the location of the or each said discontinuity is selected to control sidelobes of a beam of said energy and to enhance peak gain.

5. An antenna according to claim 1, wherein said dielectric member is supported by an expanded foam material.

6. An antenna according to claim 5, wherein said foam malarial is contained within an outer radome that extends rearwardly along said waveguide.

7. An antenna comprising:

a waveguide extending along a first direction and arranged to propagate energy forwardly from a face of said waveguide in a second direction at right angles to the first direction; and a dielectric member of generally plate shape having an edge extending parallel to said face of said waveguide and having opposite surfaces facing in directions orthogonal to said first and second directions;

wherein said dielectric member has at least one discontinuity on at least one of said surfaces arranged to scatter energy and enhance the properties of the energy radiated from the antenna, wherein said discontinuity includes a step extending along the length of said dielectric member.

8. An antenna according to claim 7, wherein said dielectric member has two steps facing in opposite directions.

9. An antenna according to claim 7, wherein said dielectric member has a step on both said surfaces.

10. An antenna according to claim 9, wherein said dielectric member has two steps facing in opposite directions on both said surfaces.

11. An antenna according to claim 9, wherein the or each said discontinuity is provided by a strip secured to each said surface of said dielectric member to extend along its length.

12. An antenna comprising:

a waveguide extending along a first direction and arranged to propagate energy forwardly from a face of said waveguide in a second direction at right angles to the first direction; and a dielectric member of generally plate shape having an edge extending parallel to said face of said waveguide and having opposite surfaces facing in directions orthogonal to said first and second directions;

wherein said dielectric member has at least one discontinuity on at least one of said surfaces arranged to scatter energy and enhance the properties of the energy radiated from the antenna, wherein the or each said discontinuity is provided by a strip secured to a said surface of said dielectric member to extend along its length.

13. An antenna comprising:

a waveguide extending along a first direction and arranged to propagate energy forwardly from a face of said waveguide in a second direction at right angles to the first direction;

a dielectric member of generally plate shape having an edge extending parallel to said face of said waveguide and having opposite surfaces facing in directions orthogonal to said first and second directions, wherein said dielectric member has at least one discontinuity on at least one of said surfaces arranged to scatter energy and enhance the properties of the energy radiated from the antenna; and a polarisation grid located forwardly of said face of said waveguide, wherein the antenna includes two horn plates extending forwardly of said polarisation grid, and wherein a rear edge of said dielectric member is located between said horn plates.

14. An antenna according to claim 13 wherein the or each said discontinuity is located forwardly of said horn plates.

15. An antenna comprising:

a waveguide extending along a first direction and arranged to propagate energy forwardly from a face of said waveguide in a second direction at right angles to the first direction; and a dielectric member of generally plate shape having an edge extending parallel to said face of said waveguide and having opposite surfaces facing in directions orthogonal to said first and second directions;

wherein said dielectric member has at least one discontinuity on at least one of said surfaces arranged to scatter energy and enhance the properties of the energy radiated from the antenna, wherein the location of the or each said discontinuity is selected to produce reflections that are substantially 180 degree out of phase with extraneous energy produced within the antenna.

16. A marine radar antenna comprising:

a waveguide extending along a first, horizontal direction for rotation about a vertical axis and arranged to propagate a beam of energy forwardly in a second, horizontal direction from a face of said waveguide; and a dielectric member of generally plate shape having an edge extending parallel to said face of said waveguide such that energy propagated from said waveguide enters said dielectric member at said edge, wherein said dielectric member has opposite surfaces facing vertically up and down, and wherein said dielectric member has at least one discontinuity on at least one of said surfaces arranged to scatter energy, so as to control one or more of sidelobes of said beam of energy and a peak gain of the antenna.

17. An antenna-comprising:

a waveguide extending along a first direction and arranged to propagate energy forwardly from a face of said waveguide in a second direction at right angles to said first direction;

a polarisation grid located forwardly of said face of said waveguide;

two horn plates extending forwardly of said polarisation grid; and a dielectric member of generally plate shape having an edge extending parallel to said polarisation grid and located between said horn plates and having opposite surfaces facing in directions orthogonal to said first and second directions, and wherein said dielectric member has a forwardly (acing step and a rearwardly facing step on both surfaces, said steps being located forwardly of a forward end of said horn plates.

* * * * *